US006059166A

United States Patent [19]

Ho et al.

[11] Patent Number: 6,059,166

[45] Date of Patent: May 9, 2000

[54] EXHAUSTED AIR DISPENSING DEVICE FOR A POWER NAILER

[75] Inventors: Roman Ho; Jack Chen; Hsuam-Chi Chiang, all of Taichung, Taiwan

[73] Assignee: Basso Industry Corp., Taichung, Taiwan

[21] Appl. No.: 09/431,135

[22] Filed: Nov. 1, 1999

[51] Int. Cl.[7] ..... B25C 1/04

[52] U.S. Cl. ..... 227/130

[58] Field of Search ..... 227/8, 130, 156

[56] References Cited

U.S. PATENT DOCUMENTS

| | | | |
|---|---|---|---|
| 5,110,030 | 5/1992 | Tanji | 227/130 |
| 5,259,465 | 11/1993 | Mukoyama | 227/130 |
| 5,485,946 | 1/1996 | Jankel | 227/130 |
| 5,715,986 | 2/1998 | Sauer | 227/130 |
| 5,782,395 | 7/1998 | Sauer | 227/130 |
| 5,881,941 | 3/1999 | Lai | 227/130 |
| 5,927,584 | 7/1999 | Akiba | 227/130 |

*Primary Examiner*—Scott A. Smith
*Attorney, Agent, or Firm*—Charles E Baxley, Esq.

[57] ABSTRACT

An exhausted air dispensing device for a hydraulic power nailer includes a ring engaged with a flange extending from a recessed area defined in an end cap of the body of the nailer. The flange has a plurality of notches which communicate with a passage from which the exhausted air of the nailer flows. The flange has a plurality of blocks extending from the ring and located in alignment with the notches in the flange so that the speed of the exhausted air is reduced when the exhausted air blows against the blocks. A cover has an opening defined in a periphery of the cover which is rotatably engaged with the recessed area. A positioning pin biasedly extends from the end cap and the cover has a plurality of dents in the bottom thereof so that the positioning pin is engaged with one of the dents of the cover.

5 Claims, 4 Drawing Sheets

EXHAUSTED AIR DISPENSING DEVICE FOR A POWER NAILER

FIELD OF THE INVENTION

The present invention relates to an exhausted air dispensing device for a hydraulic power nailer, and more particularly, to a ring and a cover mounted to the end cap of the power nailer. The ring has blocks to reduce the speed of the exhausted air flow and the cover is rotatable relative to the end cap. A positioning pin on the end cap is engaged with one of plurality of dents in the cover.

BACKGROUND OF THE INVENTION

A conventional exhausted air dispensing device for a hydraulic power nailer known to applicant is disclosed in FIGS. 1 and 2 wherein the end cap connected to the rear end of the body of the power nailer has a recessed area and a plurality of holes 11 are defined through the end cap. A cover 10 is rotatably connected to the end cap and engaged with the recessed area by extending a bolt 1 through the hole 14 in the cover 10 and the hole 16 in the recessed area of the end cap. The cover 10 has an opening 13 defined in the periphery thereof so that the exhausted air flows through the opening 13 via the holes 11 in the end cap. Although the device is well known to persons in the art, the exhausted air is still too strong so that it may impact the cover 10 to affect the rotation of the cover 10. The positioning for the cover 10 depends on only one bolt 15 which is cooperated with a washer so that it is difficult to adjust the bolt 15 to let the cover 10 be rotatable as desired. Furthermore, because the exhausted air expelled from the holes 11 of the end cap is so strong so that leakage will be found between the cover 10 and the end cap. That is to say, the exhausted air could blow in the directions that the users do not want to, for example, the exhausted could blow dust around the object to contaminate furnished surface or painted area that is not dry yet.

The present invention intends to provide an exhausted air dispensing device which effectively reduces the speed of the exhausted air blowing from the end cap of the nailer so that the exhausted air with slower speed will be easily guided to flow through the opening defined in the cover according to the user's wish. Therefore, the inherent shortcomings of the conventional exhausting air dispensing device are improved.

SUMMARY OF THE INVENTION

An exhausted air dispensing device includes an end cap connected to the body of the power nailer and a recessed area is defined in one of two ends of the end cap. A passage is defined through a surface defining the recessed area and a flange extends from the surface defining the recessed area, wherein the flange encloses the passage and a plurality of notches are defined through the flange. A ring is received in the recessed area and engaged with the flange. A plurality of blocks extend from the ring and are located in alignment with the notches in the flange. A cover has an opening defined in a periphery of the cover and the cover is rotatably engaged with the recessed area.

The primary object of the present invention is to provide an exhausting air dispensing device which effectively reduces the speed of the exhausted air blowing from the end cap of the nailer.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
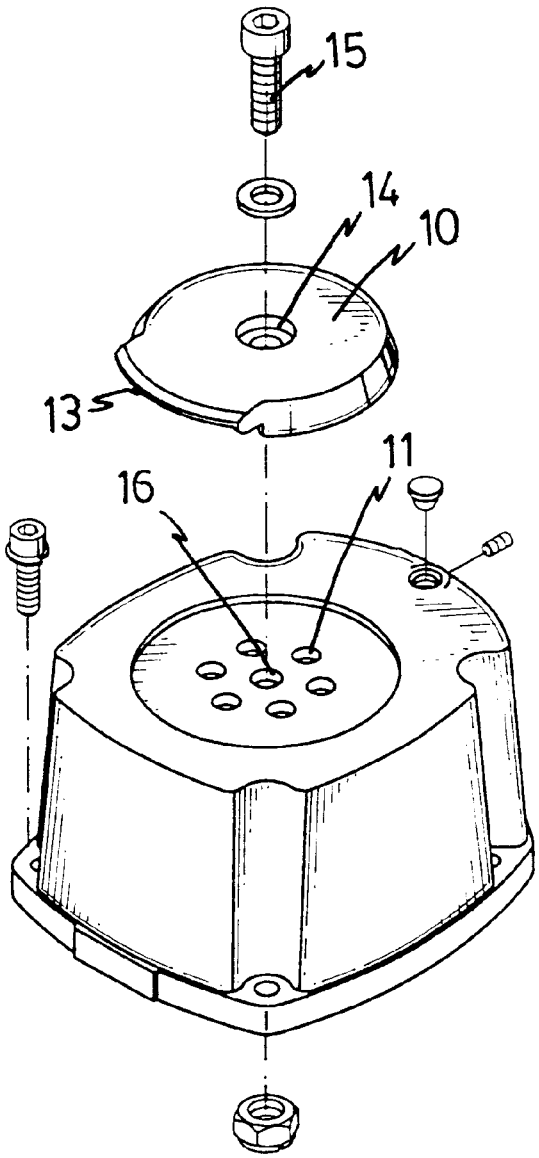
FIG. 1 PRIOR ART
FIG. 1 is an exploded view to show a conventional exhausted air dispensing device.
Figure 2:
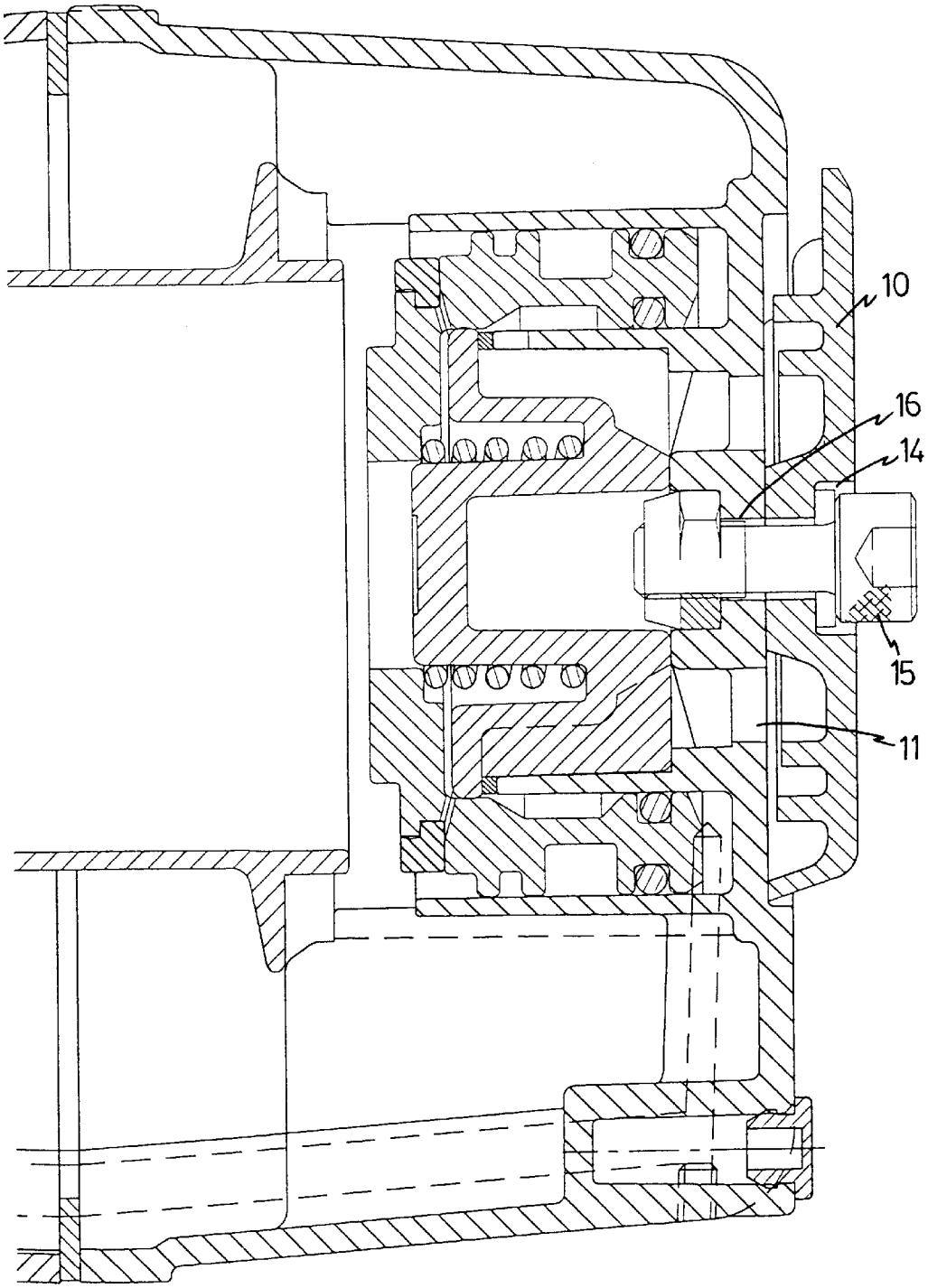
FIG. 2 PRIOR ART
FIG. 2 is a side elevational view, partly in section, of the combination of the conventional exhausted air dispensing device.
Figure 3:
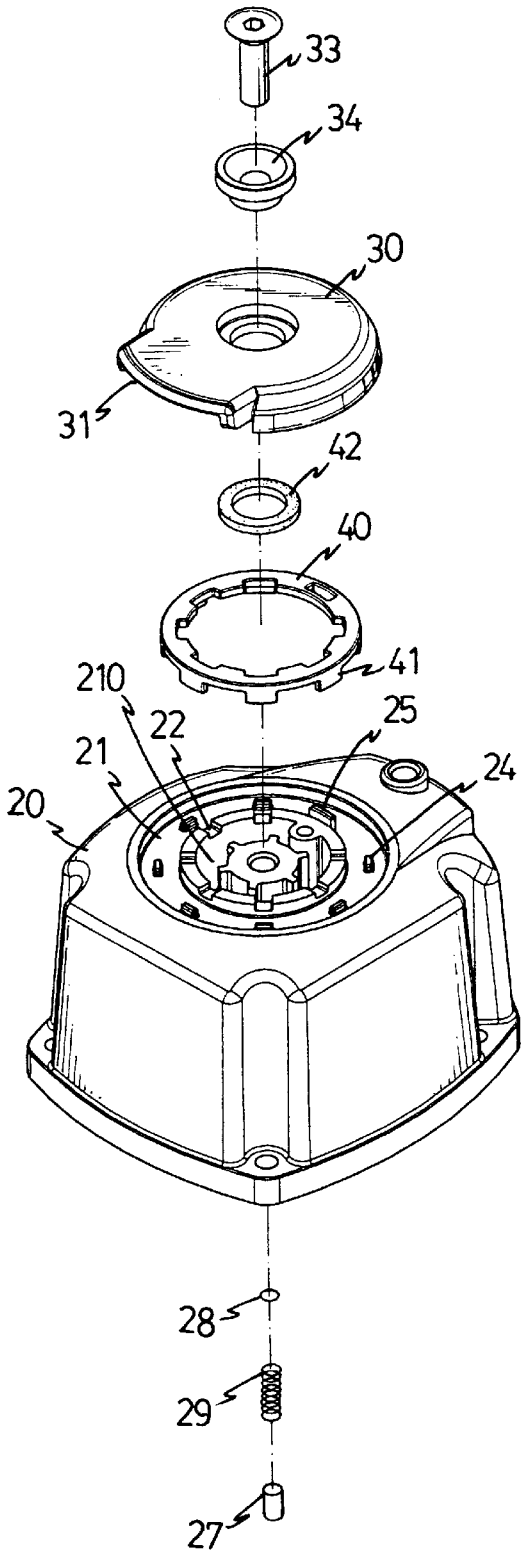
FIG. 3 is an exploded view to show the exhausted air dispensing device in accordance with the present invention.
Figure 4:
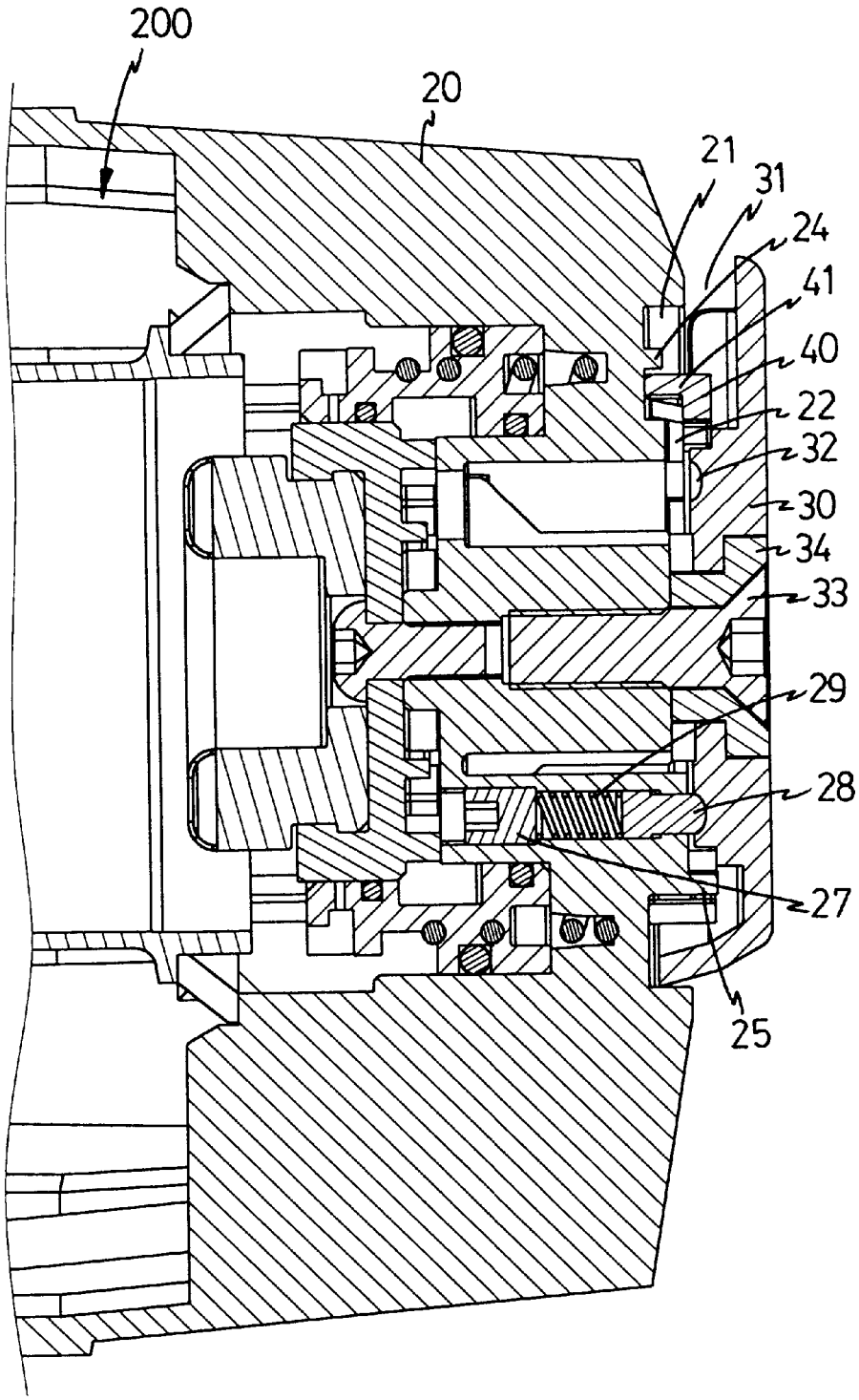
FIG. 4 is a side elevational view, partly in section, of the combination of the exhausted air dispensing device in accordance with the present invention.

Referring to FIGS. 3 and 4, the exhausted air dispensing device in accordance with the present invention comprises an end cap 20 which is connected to the body 200 of the power nailer by a known method. The end cap 20 has a recessed area 21 defined in one of two ends thereof and a passage 210 is defined through a surface defining the recessed area 21. A core portion extends through the passage 210 and the exhausted air will be ejected from the annular space around the core potion. A flange 22 extends from the surface defining the recessed area 21 and encloses the passage 210. A plurality of notches 22 are defied in the top edge of the flange 22 so that when the exhausted air ejected from the annular space around the core portion, air will flow through the notches 22. A plurality of rods 24 extend from the surface defining the recessed area 21 and are located around the flange 22. An engaging member 25 extends from the surface defining the recessed area 21 and is located adjacent to the outer periphery of the flange 22.

A ring 40 has a plurality of blocks 41 extending laterally from one of two sides thereof and the blocks 41 are located in alignment with the notches 22 in the flange 22. When the ring 40 is received in the recessed area 21 and located between the flange 22 and the rods 24, the engaging member 25 is engaged with the ring 40 to position the ring 40, and the blocks 41 are limited from any lateral play by the rods 24 contacting the blocks 41.

A cover 30 has an opening 31 defined in a periphery of the cover 30 and the cover 30 is rotatably engaged with the recessed area 21 by extending a bolt 33 through a collar 34, a central hole in the cover 30 and engaged with the core portion in the passage 210. A ring-shaped pad 42 is connected to a bottom of the cover 30 and the pad 42 is made of porous material so as to perform as a damping member to reduce the speed of the ejecting exhausted air. A positioning pin 28 extends from the flange 22 and is biased by a spring 29 which is positioned by a tubular member 27. The cover 30 has a plurality of dents 32 defined in a bottom thereof and the positioning pin 28 is engaged with one of the dents 32.

When the exhausted air ejects through the notches 220, the air flow is impeded by the blocks 41 and the rods 24 so that the speed of the exhausted air is reduced and the impacting force on the cover 30 is less. The speed-reduced exhausted air is then easily guided to flow through the opening 31. The rotation of the cover 30 is stable by engaging the positioning pin 28 in one of the dents 32 so that the directions that the exhausted air flow can be controlled.

While we have shown and described various embodiments in accordance with the present invention, it should be clear to those skilled in the art that further embodiments may be made without departing from the scope and spirit of the present invention.

What is claimed is:

1. An exhausted air dispensing device for a hydraulic power nailer which includes a body, said device comprising:

an end cap adapted to be connected to the body of the power nailer, a recessed area defined in one of two ends thereof and a passage defined through a surface defining said recessed area, a flange extending from said surface defining said recessed area and enclosing said passage, a plurality of notches defied through said flange;

a ring received in said recessed area and engaged with said flange, a plurality of blocks extending from said ring and located in alignment with said notches in said flange, and a cover having an opening defined in a periphery of said cover, said cover rotatably engaged with said recessed area.

2. The device as claimed in claim 1 further comprising a plurality of rods extending from said surface defining said recessed area, said ring located between said flange and said rods.

3. The device as claimed in claim 1 further comprising a positioning pin extending from said flange and said cover having a plurality of dents defined in a bottom thereof, said positioning pin engaged with one of said dents.

4. The device as claimed in claim 1 further comprising a ring-shaped pad connected to a bottom of said cover.

5. The device as claimed in claim 1 further comprising an engaging member extending from said surface defining said recessed area and said engaging member engaged with said ring.

* * * * *